United States Patent [19]

Filowitz et al.

[11] Patent Number: 5,021,152

[45] Date of Patent: Jun. 4, 1991

[54] ENGINE COOLANT FLUSH-FILTERING EXTERNALLY OF ENGINE WITH ION PRECIPITATION

[75] Inventors: Mark S. Filowitz, Fullerton; Marcel Vataru, Los Angeles; James L. Baylor, Fontana; Rainer H. Labus, Burbank; Laszlo G. Lugosi, Claremont, all of Calif.

[73] Assignee: Wynn Oil Company, Fullerton, Calif.

[21] Appl. No.: 308,639

[22] Filed: Feb. 10, 1989

Related U.S. Application Data

[63] Continuation-in-part of Ser. No. 256,328, Oct. 3, 1988, Pat. No. 4,901,786, and a continuation-in-part of Ser. No. 248,172, Sep. 23, 1988, Pat. No. 4,899,807, which is a continuation-in-part of Ser. No. 87,696, Aug. 20, 1987, Pat. No. 4,793,403.

[51] Int. Cl.[5] ..... C02F 1/56; F28G 13/00

[52] U.S. Cl. ..... 210/712; 210/732; 210/737; 210/765; 210/805; 210/167; 165/1

[58] Field of Search ..... 210/712, 718, 728, 732–737, 210/765, 766, 774, 805, 167, 177, 416.1; 165/1, 95, 119, 134.1; 123/41.14; 417/118

[56] References Cited

U.S. PATENT DOCUMENTS

| | | | |
|---|---|---|---|
| 1,582,300 | 4/1926 | Otis | 210/712 |
| 3,960,208 | 6/1976 | Anthony et al. | 165/1 |
| 4,052,308 | 10/1977 | Higgs | 210/167 |
| 4,615,794 | 10/1986 | Belanger | 210/737 |
| 4,791,890 | 12/1988 | Miles et al. | 165/95 |
| 4,793,403 | 12/1988 | Vataru et al. | 210/167 |
| 4,809,769 | 3/1989 | Vataru et al. | 210/167 |
| 4,899,807 | 2/1990 | Vataru et al. | 210/167 |
| 4,901,786 | 2/1990 | Vataru et al. | 210/167 |

FOREIGN PATENT DOCUMENTS 1362962 4/1964 France .

OTHER PUBLICATIONS

European Search Report EP 90 10 2607 Jul. 1990.

*Primary Examiner*—Tom Wyse
*Attorney, Agent, or Firm*—William W. Haefliger

[57] ABSTRACT

A method for rapid and efficient cleaning of an internal combustion engine cooling system includes forcing the coolant liquid from the cooling system to the exterior of that system, driving the coolant liquid from the cooling system to the exterior of that system, treating the coolant liquid in a zone or zones outside the cooling system, such treating including effecting preciptation of anions and cations, in the coolant liquid to product contaminant particulate and removing contaminant particulate from the coolant liquid, and returning the treated coolant liquid to the cooling system.

29 Claims, 4 Drawing Sheets

102
150
151
95
98
106
90
24a
96
91
97
21
100
94
109
93
23a
152
154
101
153
104
12b
12a
109

106
43
29
63
46
105
36
40

ENGINE COOLANT FLUSH-FILTERING EXTERNALLY OF ENGINE WITH ION PRECIPITATION

BACKGROUND OF THE INVENTION

This application is a Continuation-in-Part of Ser. No. 256,328 filed Oct. 3, 1988 U.S. Pat. No. 4,901,786, and a Continuation-in-Part of Ser. No. 248,172 filed Sept. 23, 1988, U.S. Pat. No. 4,899,807, each of which is a Continuation-in-Part of Ser. No. 87,696 filed Aug. 20, 1987, U.S. Pat. No. 4,793,403.

This invention relates generally to cleaning of an internal combustion engine cooling system, and more particularly to treatment of used coolant exteriorly of such a system for subsequent return to the system.

Studies show that over-heating is a major cause of vehicle breakdown on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break off, and engine blocks can become distorted or crack. Accordingly, there is a need for efficient engine cooling system flushing methods and apparatus; however, flushing of such systems in the past required draining of the removed liquid to sewer or waste lines, which was environmentally objectionable. Accordingly, need has developed for apparatus and method to clean engine coolant systems without such drainage. No way was known for accomplishing this objective in the unusually advantageous manner as is now provided by this invention. In addition, the removal of harmful cations (including those of lead, iron and copper) and anions, in the used coolant, has presented a serious problem.

SUMMARY OF THE INVENTION

It is a major object of the invention to provide procedures and apparatus characterized as overcoming the above objections and as meeting the above needs, whereby rapid and efficient cleaning of the engine coolant system may be accomplished in an environmentally non-objectionable manner.

Basically, the method of the invention embodies the steps:

(a) forcing the liquid coolant from the cooling system to the exterior of that system, (b) treating the coolant liquid in a zone or zones outside the cooling system, such treating including effecting precipitation of anions and cations in the coolant liquid to produce contaminant particulate and removing contaminant particulate from the coolant liquid, and (c) returning the treated coolant liquid to the cooling system.

As will be seen, this treating step typically includes collecting the coolant liquid in a container outside the engine cooling system, and adding anion and cation precipitating composition or compositions to coolant liquid collection in the container. The precipitating compounds are normally in a liquid state and added to mix with the coolant liquid as it flows turbulently into the container. Such components include a first composition to precipitate anions, and a second composition to precipitate cations, and the first and second compositions are added in qequence to mix with coolant liquid, in the container, the first and second compositions being synthetic polymers.

Of additional advantage is the biodegradability of such compositions at elevated temperature, the method including allowing the composition or compositions to degrade in the coolant returned to the engine, and at elevated temperatures as the coolant flows under pressurized conditions in said system, during engine operation, the composition or compositions consisting of synthetic polyelectrolyte.

It is another objective of the invention to supply a pressurized gas such as air to the cooling system in such a way as to drive coolant therefrom, for external treatment as in a holding tank zone.

Another objective is to insert a siphoning probe into the radiator associated with the engine to provide a path for coolant to exit the radiator from its lower interior, for external treatment by means of the polyelectrolyte referred to. The probe is associated with a closure for the radiator fill port, to keep that port closed during performance of the step referred to.

Another objective is to provide a path for pressurized coolant to exit the radiator from its lower interior, for external treatment as referred to, while a radiator fill port is maintained closed to prevent injury to the user, which could occur by hot fluid discharge from the radiator interior, via an open fill port.

Additional steps include filtering contaminant particulate from the coolant as it flows to the external treatment zone; adding fresh chemicals to the radiator after completion of service; employing gas pressure to drive the coolant from the holding zone back to the coolant system at the engine, and filtering the returning coolant to remove contaminant particulate.

A further objective is to employ the driving gas pressure to test the coolant system for any leakage. These and other objects and advantages of the invention, as well as the details of an illustrative embodiment, will be more fully understood from the following specification and drawings, in which:

DRAWING DESCRIPTION

DETAILED DESCRIPTION

Figure 1:
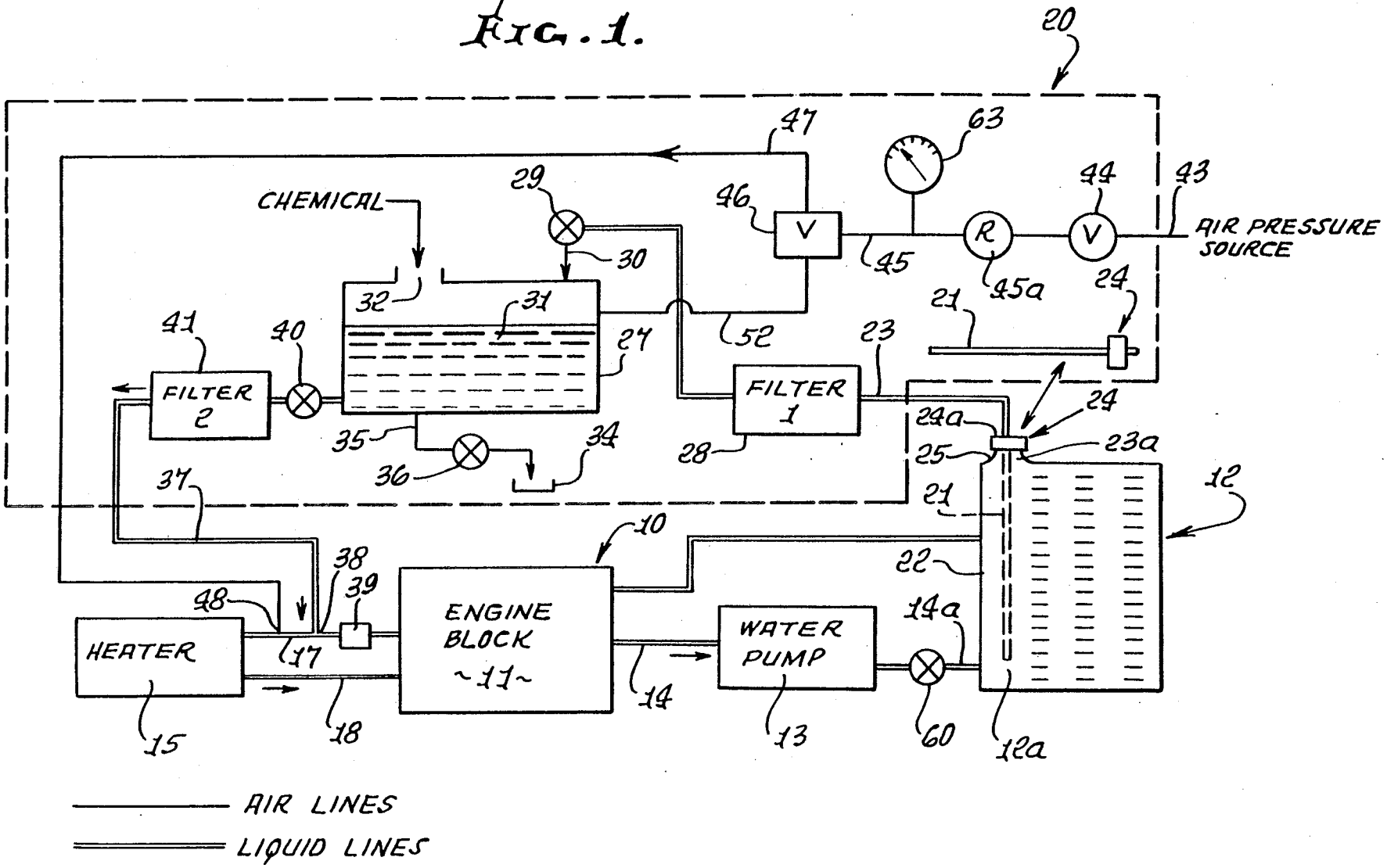
FIG. 1 is a schematic view of apparatus employing the invention.

In FIG. 1, there is schematically shown an internal combustion engine 10 having a block 11 defining a coolant passages through which liquid coolant (such as water and anti-freeze additive, including polyethylene glycol, etc.) is adapted to pass; a radiator 12; and a coolant pump 13 connected to pump coolant between the block and radiator, as via lines or ducts 14 and **14*a*. Also shown is a heater 15 connected at 17 with the block, as for use in a vehicle to be heated. From the heater, coolant may pass at 18 to the engine block 11**. During continued operation of the engine, the coolant tends to become contaminated with particulate such as rust particles and precipitate (calcium salts, etc.), and the additive degenerates. In the past, the coolant was drained from the system as to sewer lines, and the system flushed with liquid which was also drained. The present invention eliminates such environmentally objectionable draining, and also protects the operator.

In accordance with the invention, apparatus generally designated at 20 is provided, and comprises:

(a) first means for forcing the coolant liquid from the cooling system to the exterior of that system;

(b) second means in communication with said first means for receiving the coolant liquid at the exterior of the cooling system, for treatment thereof, and (c) third means in communication with said second means for returning the treated coolant liquid to the cooling system.

While specific means are shown within the overall block 20, it will be understood that other, or equivalent means are usable to perform the following steps:

(a) forcing the liquid coolant from the cooling system to the exterior of that system, (b) treating the coolant liquid in a zone or zones outside the cooling system, said treating including removing contaminant from the coolant liquid, and (c) returning the treated coolant liquid to the cooling system.

In this regard, it will be noted that the method and apparatus makes possible the re-use of the coolant by withdrawing it from the coolant system, treating it externally of that system, and recirculating the rejuvenated coolant back into the system so as to avoid need for disposal of the coolant as by drainage to the environment.

Figure 2:
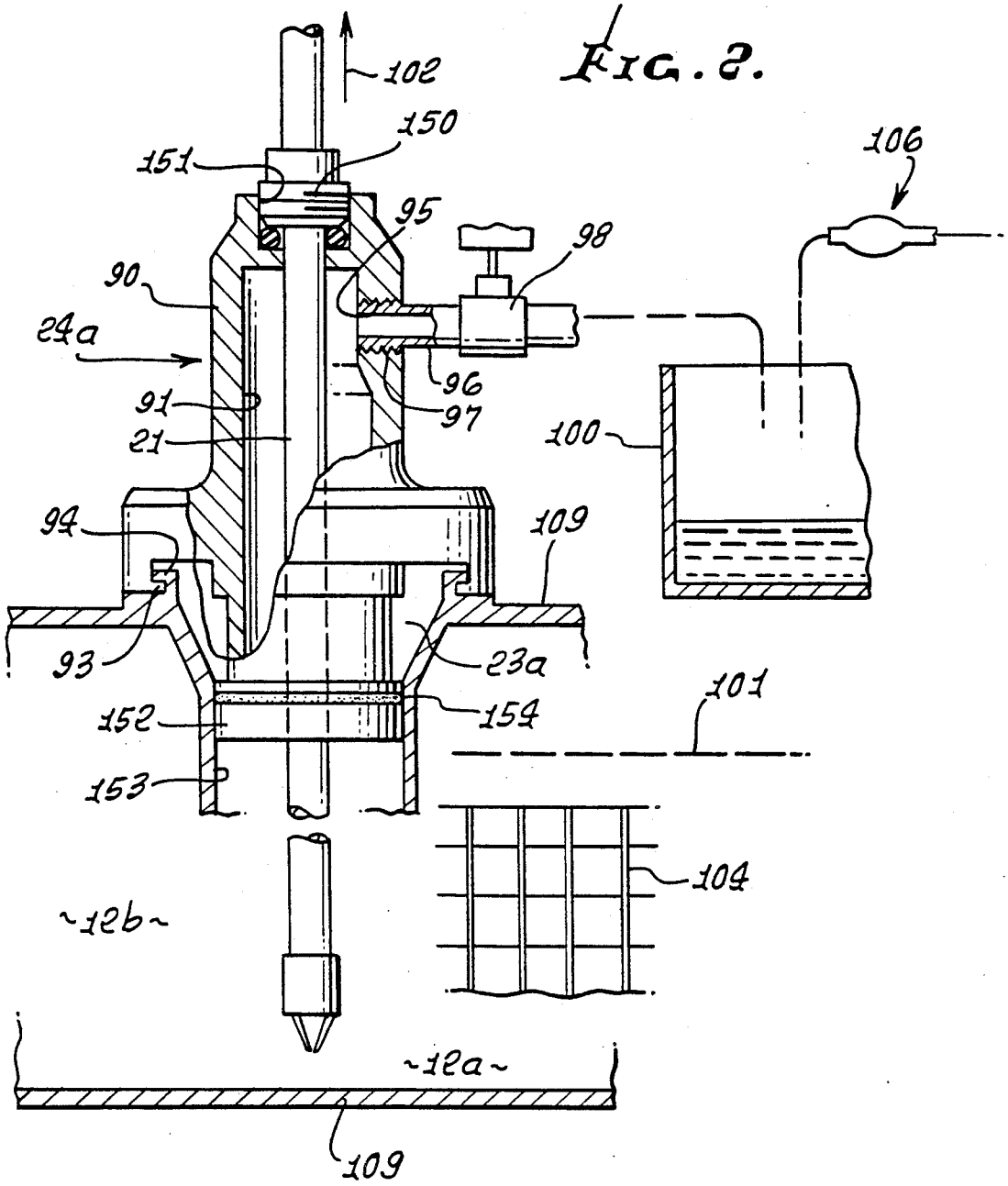
FIG. 2 is an enlarged section showing details of a radiator fill port closure at a by-pass valve.

The specific means illustrated incorporates multiple and unusual advantages in terms of simplicity, effectiveness and rapidity of employment and operation; for example, the first means for forcing the liquid coolant from the coolant system may advantageously include an elongated tube or tubular probe 21 insertible endwise into the outer container or shell 22 incorporated by the radiator, and via the usual fill opening 23*a* of that shell to extract coolant from the lower interior or extent of the radiator for passage from the radiator as via duct 23. Means 24 associated with, and typically carried by that tubular probe 21, is provided for maintaining the fill opening otherwise closed during removal of coolant from the radiator. Such means may comprise a screw-on cap 24 which is annular to pass the elongated tube 21. Cap is screwed onto the neck 25 of the radiator fill opening, the probe then reaching or extending to the bottom interior of the radiator so that substantially all liquid may be removed, extracted or siphoned from the radiator to the line 23. As will appear, liquid in the heater and block flows to the radiator for such removal, and typically under pressure within the radiator so as to flow up the tubular probe to the external line 23 and then to a treatment zone. FIG. 2 shows cap details.

The second means for treating the removed coolant may advantageously comprise a liquid receiver, such as for example, a holding tank 27 to which liquid flows via line 23, filter 28 connected in series with that line, and valve 29 in the line. Particulate and congealed substances in the flowing liquid are removed by the filter 28, which may be replaced at intervals; the used-up filter then being disposed of in accordance with environmentally acceptable safe procedures. The normally aqueous liquid received into the holding tank interior zone 31, as via inlet 30, may then be preated, as by addition of chemical agent or agents introduced via port 32. Such chemicals may include corrosion inhibitor, i.e., anti-rust compounds, pH adjustment chemicals, and fresh anti-freeze compound (glycol, for example). If any sludge develops in tank 27 after prolonged use, it may be removed to a container 34 and disposed of, environmentally safely. See line 35 and valve 36.

The third means for returning the treated coolant to the engine cooling system includes a line or duct 37 extending from tank 27 to a connection 38 with the cooling system. Connection 38 is advantageously located in the line 17 from the block 11 to the heater. A clamp 39 may be located on or at that line for stopping liquid passing from 38 to the block, via line 17. A control valve 40 and a filter 41 are connected in series with line 37, valve 40 being opened when return of coolant to the system is desired. Filter 41 removes any further contaminant.

In association with the first means referred to above, is a pressurized gas (as for example air pressure) source 43 connectible via a main valve 44 in duct 45 and a control valve 46, connected via duct 47 with the coolant system, for forcing coolant from that system and to tank 27 (as via the probe 21 and line 23). Line 47 may be connected to duct 17, at 48, as shown. Air pressure then drives coolant from the heater to the radiator, as via line 18, and the pump 13, coolant also flowing from the block to the radiator lower interior extent 12*a*, for pick up by the probe 21.

Valve 46 is advantageously a three-way valve, and is thus controllable to alternatively supply air under pressure via line 52 to the holding tank interior for application to treated liquid 31 in the tank for return supply under pressure to the engine cooling system, along the flow path described above.

Prior to initial operation of the system, the engine is operated to heat the coolant in the system, and as a result, a thermostat-controlled valve in that system, indicated at 60, is opened when the coolant reaches a predetermined temperature. Rust loosening or cleaning chemical additive (such as detergent solution) may be initially added to the coolant in the radiator to circulate during warm-up. The probe 21 is then inserted in the radiator, and operation of the apparatus is begun. Note that the apparatus is quickly connectible to the cooling system, as via hoses or lines 23, 37 and 47.

A pressure gauge 63 is connected to air line 45 to indicate the pressure in that line. After air pressure has returned the treated coolant to the system, the radiator fill opening 23*a* is closed as by returning the radiator cap to neck 25, and tightening it to seal the opening 23*a*. Thereafter air pressure from supply 43 pressurizes the entire coolant system, and gauge 63 is observed to note the pressure. Air pressure regulator 45*a* in line 45 regulates the pressure to a safe level. Valve 44 is then closed, and the gauge 63 is again observed to note any relatively rapid fall-off of pressure. If that does not occur, the pressure test indicates a non-leaking system; however, if the pressure falls off, the test indicates that a leak has developed in the coolant system, and should be attended to. For example, a STOP-LEAK solution may be added to the contents of the radiator in an effort to arrest the pressure leak.

In FIG. 2, the modified cap 24a has a domed wall 90 with a central through opening 91 to pass tubular probe 21. A seal 92 carried by the cap seals off against the outer surface of the probe (which may be plasti(c) when threaded fitting 150 is tightened in ise, relative to opening 91, when fitting 150 is loosened. The cap has a lower lip 93 that tightens on the annular lip 94 of the radiator container, as shown, at which time an annular extension 152 fits in radiator bore 153, sealing at 154. An off-set through port 95 has a by-pass duct 96 connected therewith at 97, and a * manually controllable by-pass valve 98 in duct 96 controls escape of pressurized fluid from the radiator upper interior 12*b*, and to an over-flow tank 100. Bypass valve 98 is opened as during air pressure induced return of treated coolant fluid to the system, that fluid allowed to rise in the radiator, to level 101, above indicator core 104. Any excess fluid (air or coolant or both) rising in the radiator exits via the by-pass duct and valve 98, to tank 100. Thus, hot fluid under pressure cannot discharge in direction 102, outside probe 21, since the radiator fill port 23*a* is closed by cap or closure 24*a*. Duct 96 is transparent so that any loss of coolant can be visually monitored. Coolant collected in tank 100 can be returned to tank 27, as by siphoning. See siphon 106. The radiator container or shell appears at 109.

Figure 4:
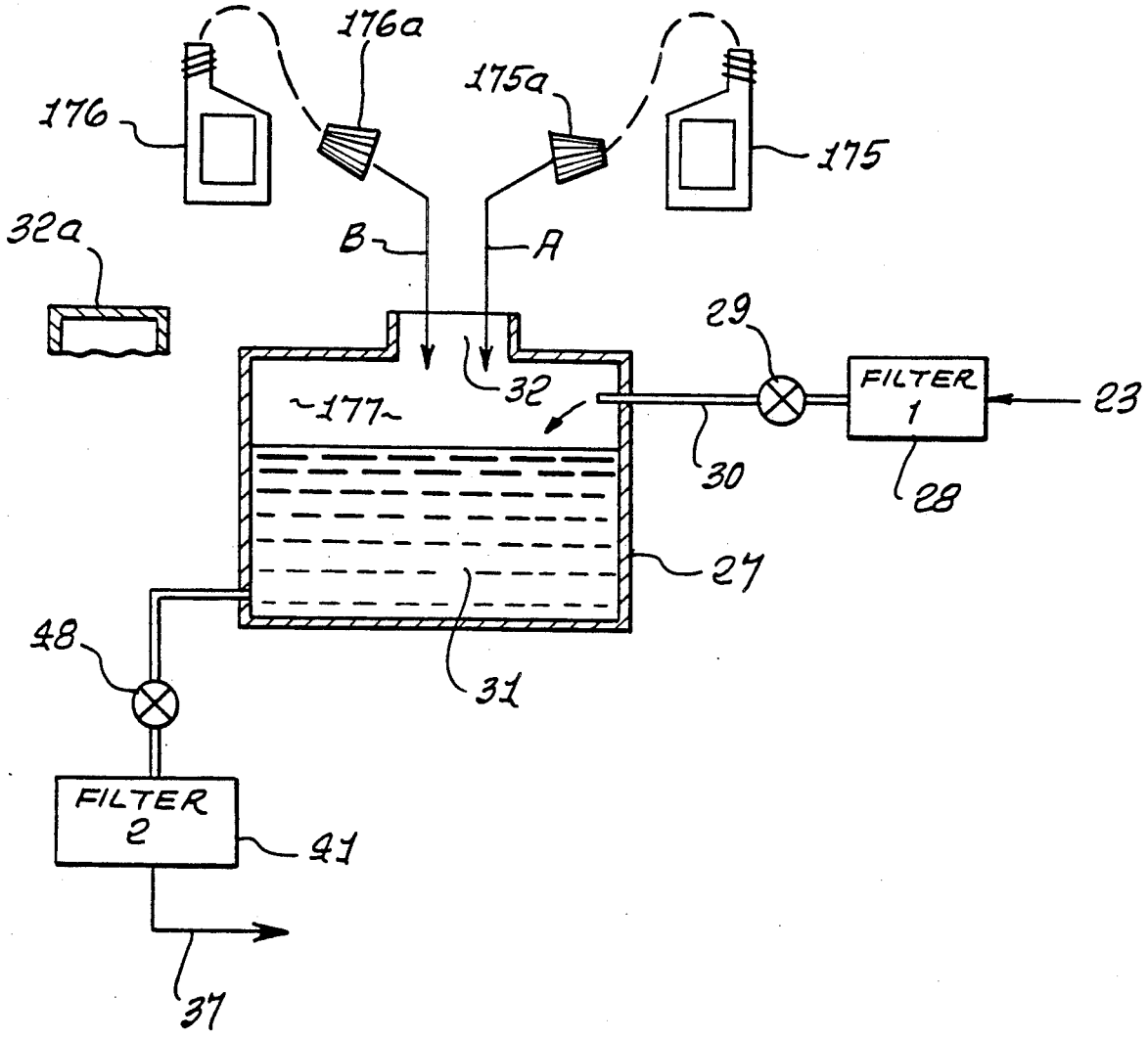
FIG. 4 is a fragmentary view of system components.

Referring to FIG. 4, elements corresponding to those in FIG. 1 bear corresponding identifying numerals. Also shown are two bottles 175 and 176 for polymeric compositions indicated at A and B as being poured (sequentially) into the coolant liquid being turbulently filled into the container 27 as via line 30. Accordingly, good mixing of A and B with the coolant liquid in the container interior zone 177 is obtained. The method involves treating (as by mixing) of the normally cloudy coolant liquid 31 with first A and then B, thereby effecting precipitation of anions, and cations, in the coolant liquid to produce particle form contaminant (particulate) which is then filterable at 41 as the treated coolant liquid is returned, under pressure, to the cooling system via 40, 41 and 37, as described above. Such precipitate is over about 5 microns in size, normally. The filtered coolant at 37 is a clear liquid.

Typically, the precipitating compositions A and B are in liquid form and are added to the coolant 31 being filled into 27, as via dispensers 175*a* and 176*a* such as hollow caps for the bottles 175 and 176 in which A and B are supplied. First composition A precipitates anions (such as sulfate, chloride, etc.), and second composition B precipitates cations (such as metal ions—i.e. of lead, iron, copper, etc.) found in coolant liquid circulating in engine coolant systems as described above.

The two compositions are synthetic polymers, and polyelectrolytic, and typically in aqueous solution in the bottles. An example of the relative proportions of the mix is as follows: (for complete or substantially complete precipitation of the anion and cation contents of normal radiator coolant, in terms of stoichiometric equivalence):

about 3 gallons of coolant liquid consisting essentially of polyethylene glycol, water, dissolved salts, and particulate;

about ¼ to ¾ ounce of said first composition PROTAZYNE, which is an 8% aqueous solution of cationic polyelectrolyte, or equivalent;

about ½ to 1½ ounces of said second composition NETAMOX, which is a 5% aqueous solution of anionic polyelectrolyte, or equivalent, and a 5% aqueous solution of heavy metal precipitant.

Composition B (the NETAMOX) preferably contains, as a portion of the ½ to 1½ ounces, the heavy metal precipitant sodium dimethyl dithiocarbamate in 0.5% to 1.5% aqueous solution form.

More specifically, the anionic polyelectrolyte in composition B is sold under the trade name HYROFLOC 495L (produced by Aqua Ben Corp., Orange, Calif.) and has a boiling point of about 220° F., a specific gravity 1.02 gm/cc, a pH of about 8.2, and a chemical formula:

$$-CH_2-\underset{\underset{X}{|}}{CH}-n$$

The "PROTAZYNE" composition A is a cationic polyelectrolyte sold under the trade name HYDROFLOC 865 (produced by Aqua Ben Corp., Orange, Calif.), and has a boiling point of about 220° F., a specific gravity of 1.0, vapor pressure 17.5 mm $H_g$, vapor density of 1, pH of 6, and chemical formula $$-CH_2-\underset{\underset{X}{|}}{CH}-n$$

The following tables illustrate results obtained in terms of metal ion reduction:

TABLE I

COOLANT ANALYSIS BEFORE AND AFTER TREATMENT

| | 1971 Ford Pinto 144.6K Miles | | 1977 Dodge Van 103.9K Miles | |
|---|---|---|---|---|
| | Before | After | Before | After |
| Fe[1] | 15.5 | <0.1 | 59.4 | 2.2 |
| Pb[1] | — | — | 13.0 | <0.1 |
| Cu[1] | 12.0 | <0.1 | 6.2 | <0.1 |

[1](ppm) by AA

TABLE II

COOLANT ANALYSIS BEFORE AND AFTER TREATMENT

| | 1985 Nissan Pickup 64K Miles | | 1986 Merkur XR4T 54.4K Miles | | 1984 Chrysler Dodge Daytona 79.7K miles | | 1977 NISSAN 200SX 135.2K Miles | |
|---|---|---|---|---|---|---|---|---|
| | Before | After | Before | After | Before | After | Before | After |
| Pb[1] | 0.2 | <0.1 | 18.3 | <0.1 | 24.5 | <0.1 | 42.0 | <0.1 |
| Fe[1] | 0.1 | <0.1 | 28.4 | <0.1 | 21.4 | <0.1 | 5.5 | <0.1 |
| Cu[1] | — | — | — | — | 20.6 | <0.1 | 1.0 | <0.1 |

[1](ppm) by AA

TABLE III

ANALYSIS OF MARK X FILTERS (SEE FILTER 41) AFTER TREATING CARS IN THE FIELD

| | 1975 Ford Ltd 109.6K Miles | | 1978 Chevrolet Monza 138.5K Miles | | 1979 Pontiac Firebird 163K Miles | | 1964 Chevrolet Imapala 156.6K Miles | |
|---|---|---|---|---|---|---|---|---|
| | Primary | Secondary | Primary | Secondary | Primary | Secondary | Primary | Secondary |
| Fe[1] | 17.9 | 22.2 | 11.4 | 0.9 | 14.6 | 4.6 | 10.6 | 9.6 |
| Pb[1] | 11.6 | 2.9 | 4.6 | 4.2 | 2.2 | 1.5 | 6.2 | 3.5 |
| Cu[1] | 7.9 | 24.6 | 15.4 | 289.0 | 28.6 | 94.6 | 15.9 | 94.6 |

[1](ppm) by AA

SUMMARY OF OPERATION

The following is a summary of steps that may be carried out during performance of the method of the (1) Add cleaning or flushing chemicals to engine coolant system after preliminarily testing the system for leaks;

(2) connect apparatus 20 to the cooling system as shown in FIG. 1, and as described above;

(3) operate engine for about 10 minutes to circulate the chemicals for loosening dirt, rust, sludge, etc., and also to warm up coolant solution so that thermostat-controlled valve 60 opens, at about 190°–205° F.;

(4) insert probe 26 into radiator and tighten its cap means 24*a* to the lip 94;

(5) open valve 44 and adjust valve 46 to direct air pressure to connection 48, which causes air pressure to drive coolant from the system to holding tank 27, via probe 21, filter 28, and valve 29, which is OPEN;

(6) close valve 44;

(7) leave probe 21 in the radiator, and leave fill-opening 23*a* closed by cap 24*a*. Open by-pass valve 98;

(8) open valve 44 and adjust valve 46 to direct air pressure to tank 27, via line 52. Inlet 32 should be closed, as by a cap 32*a*. This drives coolant from the tank, through filter 41, and to the coolant system at line 17. Excess air or fluid vents via valve 98;

(9) when all coolant has been returned to the system (as can be viewed via line 37 which is

(10) pressurize the coolant system, and close valve 44;

(11) observe gauge 63 for any pressure leaks;

(12) relieve pressure in the system as by slowly opening the overflow valve attached to the cap at the radiator neck 25;

(13) disconnect the hoses or lines from the line 17; and replace the standard radiator cap to neck 25, after withdrawing probe 21.

The compositions A and B are added to the coolant 31 during step 5; first A is added (PROTAZYNE) and then B is added (NETAMOX). They may be dyed different colors to differentiate them in use. The procedure (1)14 (12) may be repeated one or two times (cycles) to optimize removal of contaminants, especially in dirty radiators. Should compositions A or B reach the engine coolant system, the synthetic polymers A and B tend to biodegrade during engine operation at elevated temperature, with the coolant (anti-freeze) under system pressure.

The connections to line 17 may take the form of those described in U.S. Pat. No. 4,109,703, FIG. 12.

Figure 3:
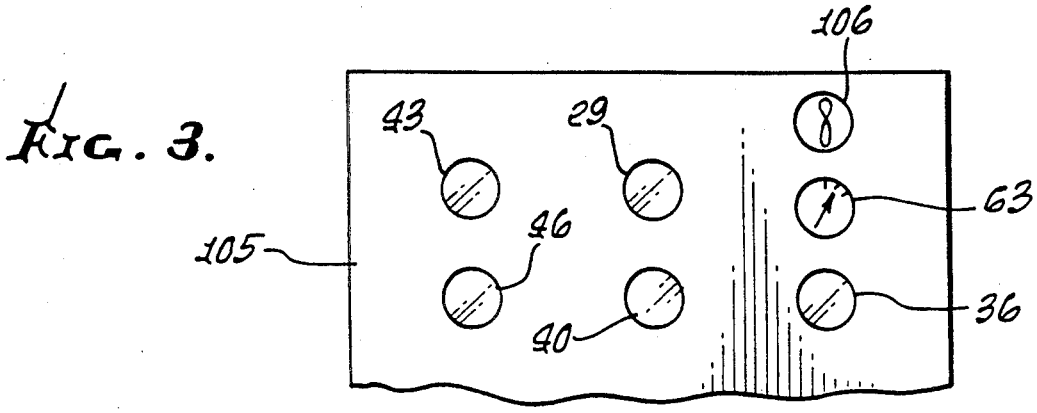
FIG. 3 is a front view of a control console.

FIG. 3 shows valve controls on a console panel 105, along with gauge 63. A flow indicator (spinner) connected into line 17, is shown at 106.

Figure 5:
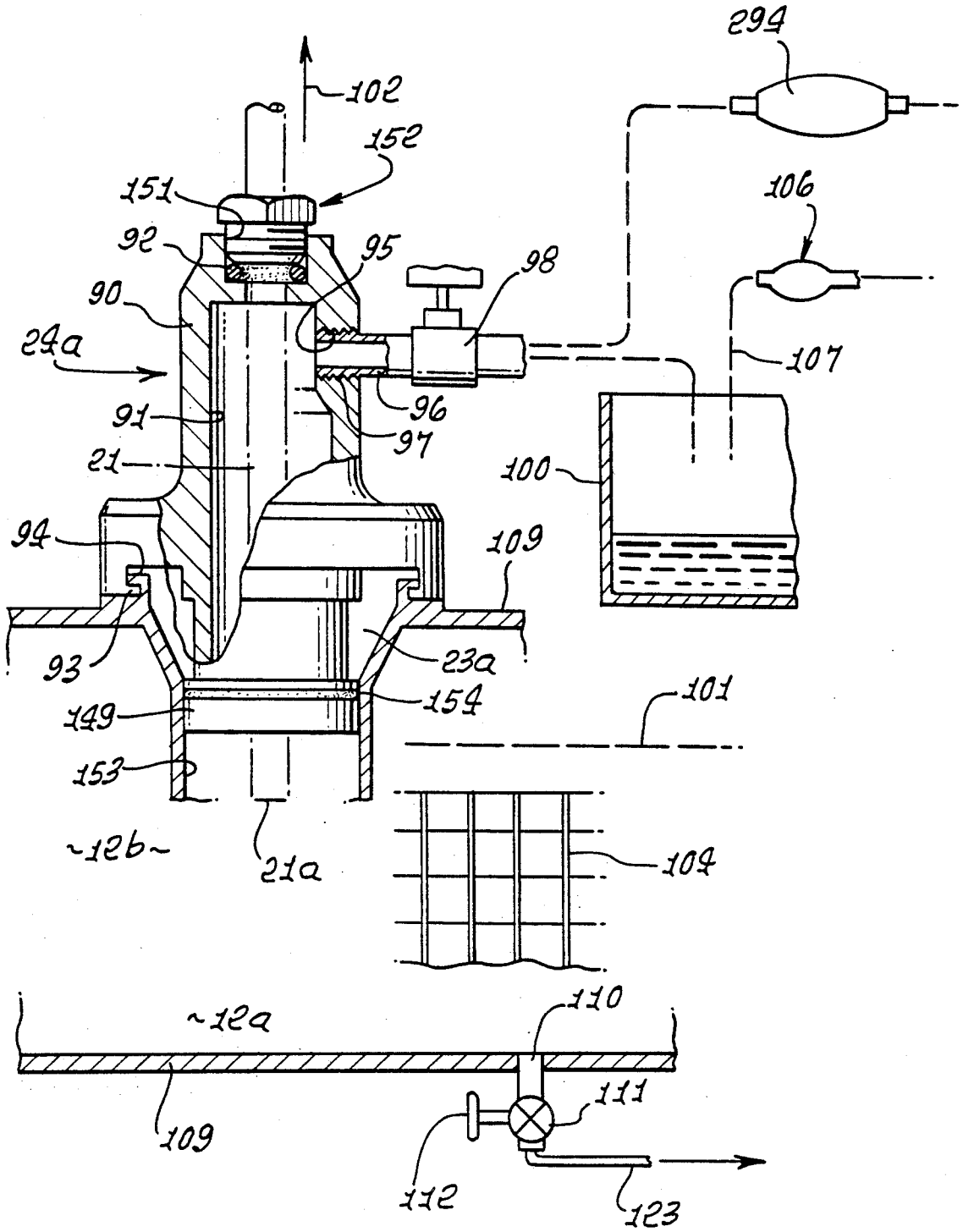
FIG. 5 is a view like FIG. 2 showing alternative structures.

The specific alternate system illustrated in FIG. 5 incorporates multiple and unusual advantages in terms of simplicity, effectiveness and rapidity of employment and operation; for example, the first means for forcing the liquid coolant from the coolant system may advantageously include a coolant discharge port 110 at the bottom of the radiator in series with a valve 111, manually controlled at 112, for return of air pressurized coolant from the lower interior or extent of the radiator, i.e., for passage from the radiator as via duct 123, and return to tank 27, such a valve temporarily replacing the original equipment valve.

Means 24 is provided for maintaining the usual radiator fill opening 23*a* otherwise closed during removal of coolant from the radiator. Such means may comprise a screw-on cap 24*a* which is located above the upper interior 12*b* of the radiator, above finned tubes 104. Cap 24*a* is screwed onto the neck of the radiator fill opening, as at screw connection 93, 94. Valve 111 at the bottom wall 109 of the radiator container communicates with the bottom interior 12*a* of the container so that substantially all pressurized coolant liquid may be removed, extracted or drained from the radiator, to the line 123 for flow to the first filter at 28. As will appear, liquid in the heater and engine block flows to the radiator for such removal.

Modified cap 24*a* for fill port 23*a* has a domed wall 90 with a central through opening 91 usable for example to induce a vacuum at the upper interior 12*b* of the radiator. See siphon bulb 294 in series with by-pass valve 98 in FIG. 5. A seal 92 carried by the cap seals off when a threaded fitting 152 is tightened in threaded bore 151, to close the cap 24*a* The cap has a lower lip 93 that tightens on the annular lip 94 of the radiator container, as shown, at which time an annular extension 149 fits in radiator bore An offset through port 95 in wall 90 has a duct 96 connected therewith, at 97, and a manually controllable by-pass valve 98 in duct 96 controls escape of pressurized fluid from the radiator upper interior 12*b* to an over-flow tank 100. Valve 98 of treated coolant fluid to the system, that fluid normally allowed to rise in the radiator to level 101 above radiator core 104. Any excess fluid (air to coolant, or both) rising in the radiator exits via the by-pass duct and valve 98 in tank 100. Thus, hot fluid under pressure cannot freely discharge in direction 102 outside, since the radiator fill port 23*a* is closed by cap 24*a*, with fitting 152 installed in bore 151. Bypass valve 98 is also used with a siphon-vacuum bulb 294, to induce vacuum at 12*b*, as when original equipment fitting is removed from the bottom of radiator and special coolant discharge port or duct 110 is installed into bottom of radiator at 109, in series with valve 111.

Coolant collected in tank 100 can be siphoned out and returned to tank 27, as by a siphon which includes hose 107 and bulb 106. Radiator shell or container 109 contains core 104. Alternatively, the first means for forcing the liquid coolant from the coolant system may advantageously include an elongated tube or tubular probe 21 insertible endwise into the outer container or shell 22 incorporated by the radiator, and via the port 151 in cap 24*a*, to extract coolant from the lower interior or extent of the radiator for passage from the radiator as via return duct 23.

The second means for treating the removed coolant may advantageously comprise, as in FIG. 1, a liquid receiver, such as for example a holding tank 27 to which liquid flows via line 23, filter 28 connected in series with that line, and valve 29 in the line. Particulate and congealed substances in the flowing liquid are removed by the filter 28, which may be replaced at intervals; the used-up filter then being disposed of in accordance with environmentally acceptably safe procedures. The normally aqueous liquid received into the holding tank interior zone 31, as via inlet 30 may then be treated. Chemicals to be added to the radiator, after return of treated coolant to the radiator include compositions A and B, corrosion inhibitor, i.e., anti-rust compound, pH adjustment chemicals, and fresh anti-freeze compound (glycol, for example). If any sludge develops in tank 27 after prolonged use, it may be removed to a container 34 and disposed of, environmentally safe. See line 35 and valve 36.

The third means for returning the treated coolant to the engine cooling system includes a line or duct 37 extending from tank 27 to a connection 38 with the cooling system. Connection 38 is advantageously located in the line 17 from the block 11 to the heater. A clamp 39 may be located on or at that line for stopping liquid passing from 38 to the block, via line 17. A control valve 40 and a filter 41 are connected in series with line 37, valve 40 being opened when return of coolant to the system is desired. Filter 41 removes any further contaminant.

SUMMARY OF THE OPERATION

The following is a summary of steps that may be carried out during performance of the method of the invention, incorporating the FIG. 5 apparatus:

(1) Add cleaning or flushing chemicals to engine coolant system after preliminarily testing the system for leaks.

(2) Connect apparatus 20 and cap 24*a* to the cooling system as shown in FIGS. 1 and 2, and as described above.

(3) Operate engine for about 10 minutes to circulate the chemicals for loosening dirt, rust, sludge, etc., and also warm up coolant solution so that thermostat-controlled valve 60 opens, at about 190°–205° F.

(4) Make sure that cap means 24*a* is connected to the lip 94, the cap port 151 plugged by plug 152.

(5) Open valve 44 and adjust valve 46 to direct air pressure to connection 48, which causes air pressure to drive coolant from the system to holding tank 27, via port 110, valve 111, filter 28, and valve 29, which is OPEN. Compositions A and B are then added in sequence to liquid 31 in tank 27, as described.

(6) Close valve 44.

(7) Leave fill-opening 23*a* closed by cap 24*a*. Open by-pass valve 98. Close valve 111.

(8) Open valve 44 and adjust valve 46 to direct air pressure to tank 27, via line 52. Inlet 32 should be closed. This drives coolant from the tank, through filter 41, and to the coolant system at line 17. Coolant rises to level 101 in the radiator. Excess air or coolant fluid vents via by-pass valve 98; and to tank 100.

(9) When all coolant has been returned to the system, the by-pass valve 98 is closed.

(10) Relieve pressure in the system as by slowly opening the valve 98 at the side of cap 24*a*. Any flow via transparent line 96 can be viewed.

(11) Remove cap 24*a* from radiator neck.

(12) Disconnect the hoses or lines from the line 17.

(13) Add treating chemical and anti-freeze (if necessary) to radiator, via open port 23*a*.

(14) A standard radiator cap can then be attached to the radiator neck.

The connections to line 17 may take the form of those described in U.S. Pat. No. 4,109,703, FIG. 12.

We claim:

1. In the method of treating coolant liquid in an internal combustion engine cooling system, the steps that include:

(a) forcing the coolant liquid from the cooling system to the exterior of that system, (b) treating the coolant liquid in a zone or zones outside the cooling system, said treating including effecting precipitation of anions and cations, in the coolant liquid to produce contaminant particulate and removing contaminant particulate from the coolant liquid, and (c) returning the treated coolant liquid to the cooling system.

2. The method of claim 1 wherein said treating step includes collecting the coolant liquid in a container outside the engine cooling system, and adding anion and cation precipitating composition or compositions to coolant liquid collecting in the container.

3. The method of claim 2 wherein said precipitating composition or compositions are in liquid form and are added to mix the coolant liquid as it flows turbulently into the container.

4. The method of claim 3 wherein said compositions include a first composition to precipitate and a second composition to precipitate cations, and said first and second compositions are added in sequence to mix with coolant liquid, in the container, said first and second compositions being synthetic polymers.

5. The method of claim 4 wherein said coolant liquid contains anions from the group consisting essentially of iron, lead and copper, for precipitation by said first composition.

6. The method of claim 4 wherein said first composition consists of an aqueous solution of PROTAZYNE, or equivalent.

7. The method of claim 4 wherein said second composition consists of an aqueous solution of NETAMOX, or equivalent. relative proportions of said coolant liquid collected in said container and of said compositions are about as follows:

about 3 gallons of coolant liquid consisting essentially of polyethylene glycol, water, dissolved salts, and particulate;

about ¼ to ¾ ounce of said first composition PROTAZYNE, which is an 8% aqueous solution of cationic polyelectrolyte, or equivalent;

about ½ to 1½ ounces of said second composition NETAMOX, which is a 5% aqueous solution of anionic polyelectrolyte, or equivalent, and a 5% aqueous solution of heavy metal precipitant.

8. The method of claim 4 wherein said first composition is a cationic polyelectrolyte, and said second composition is an anionic polyelectrolyte.

9. The method of claim 4 wherein said first and second compositions respectively consist essentially of HYDROFLOC 865 and HYDROFLOC 495L.

10. The method of claim 2 including allowing said composition or compositions to degrade in the coolant returned to the engine, and at elevated temperature as the coolant flows under pressurized conditions in said system, during engine operation, said composition or compositions consisting of a synthetic polyelectrolyte.

11. The method of claim 1 wherein said forcing step includes supplying a pressurized gas to the cooling system to drive coolant liquid therefrom.

12. The method of claim 11 wherein the cooling system includes a heat radiator including a container having a coolant liquid fill opening, and said forcing step includes employing said gas to drive coolant liquid from the radiator via said container fill opening.

13. The method of claim 3 including providing an elongated tube and inserting the tube into the radiator via said fill opening to extract said coolant liquid from the lower extent of the radiator for said passage from the radiator.

14. The method of claim 1 wherien said treating step includes filtering contaminant particles from the cooling liquid.

15. The method of claim 14 wherien said filtering removes contaminant particles above about 20 microns from the cooling liquid prior to reception of said liquid in said zone or zones.

16. The method of claim 14 wherein said returning step includes filtering the liquid while returning the liquid from said zone or zones to the cooling system.

17. The method of claim 16 wherein the cooling system includes cooling passages in an engine block and in a heater, there being a coolant flow connection passage between said coolant passages in the block and heater, and wherein said returning step includes returning the treated liquid to said flow connection passage.

18. The method of claim 1 wherein said returning step includes supplying pressurized gas to drive treated coolant into the cooling system.

19. The method of claim 16 wherein said returning step includes supplying pressurized gas to the holding zone to drive treated liquid therefrom and to the cooling system.

20. The method of claim 18 wherein the cooling system includes a heat radiator including a container having a coolant liquid fill opening, and including the step of maintaining that fill opening open during the gas prsesure driving of treated liquid to the cooling system so as to pass spent gas from the cooling system.

21. The method of claim 1 wherein:

(d) said forcing step includes supplying a pressurized gas to the cooling system to drive coolant liquid therefrom, (e) the cooling system, including a heat radiator which includes a container having a coolant liquid fill opening, and a valve controlled discharge port proximate the bottom of the radiator, an said forcing step includign employing said gas to drive coolant liquid from the radiator via said discharge port.

22. The method of claim 21 including the step of maintaining said fill opening closed during said forcing step.

23. The method of claim 21 including controllably venting fluid which includes gas from said container via said fill opening, during said step of returning the treated coolant to the cooling system.

24. The method of claim 23 including applying a closure to said fill opening, there being a by-pass valve connected with said closure, and carrying out said venting via said by-pass valve.

25. The method of claim 1 wherein said treating step includes filtering contaminant particles from the cooling liquid.

26. The method of claim 21 wherein said returning step includes filtering the liquid while returning the liquid from the holding zone to the cooling system.

27. The method of claim 26 wherein the cooling system includes cooling passages in an engine block and in a heater, there being a coolant flow connection passage between said coolant passages in the block and heater, and wherein said returning step includes returning the treated liquid to said flow connection passage.

28. The method of claim 21 wherein said returning step includes supplying pressurized gas to drive treated coolant into the cooling system.

29. In the method of treating cooling liquid employed to cool an internal combustion engine cooling system, the steps that include:

(a) forcing the coolant liquid from the cooling system to the exterior of that system, (b) treating the coolant liquid, including effecting precipitation of anions and cations in the coolant liquid to produce contaminant particles, and filtering contaminant particles from the coolant liquid, and (c) returning to the cooling system the treated liquid from which precipitated contaminant particles have been removed by said filtering.

* * * * *

UNITED STATES PATENT AND TRADEMARK OFFICE

CERTIFICATE OF CORRECTION

PATENT NO. : 5,021,152

DATED : June 4,1991

INVENTOR(S) : Mark S. Filowitz, Marcel Vataru, James L. Baylor, Rainer H. Labus and Laszlo G. Lugosi It is certified that error appears in the above-identified patent and that said Letters Patent is hereby corrected as shown below:

Column 10, line 39; delete "include a first composition to precipitate and a second" and substitute --include a first composition to precipitate anions and a second--

Column 10, line 53; delete "or equivalent. relative proportions of said coolant liquid" and substitute --or equivalent.--

Column 10, line 54; delete "collected in said container and of said compositions are" and substitute --8. The method of claim 4 wherein the relative proportions of said coolant liquid collected in said container and of said compositions are--

Column 10, line 66; delete "8." and substitute --9.--

Column 11, line 1; delete "9." and substitute--10.--

Column 11, line 4; delete "10." and substitute --11.--

Column 11, line 10; delete "11." and substitute --12.--

Column 11, line 13; delete "12. The method of claim 11 wherein the cooling sys-" and substitute --13. The method of claim 12 wherein the cooling sys- --

Column 11, line 19; delete "13." and substitute --14.--

Column 11, line 24; delete "14." and substitute --15.--

Column 11, line 27; delete "15. The method of claim 14 wherien said filtering" and substitute --16. The method of claim 15 wherein said filtering--

UNITED STATES PATENT AND TRADEMARK OFFICE

CERTIFICATE OF CORRECTION

PATENT NO. : 5,021,152

DATED : June 4, 1991

INVENTOR(S) : Mark S. Filowitz, Marcel Vataru, James L. Baylor, Rainer H. Labus and Laszlo G. Lugosi It is certified that error appears in the above-identified patent and that said Letters Patent is hereby corrected as shown below:

Column 11, line 32; delete "16. The method of claim 14 wherein said returning" and substitute --17. The method of claim 15 wherein said returning--

Column 11, line 35; delete "17. The method of claim 16 wherein the cooling sys-" and substitute --18. The method of claim 17 wherein the cooling sys- --

Column 11, line 41; delete "18." and substitute --19.--

Column 11, line 44; delete "19. The method of claim 16 wherein said returning" and substitute --20. The method of claim 17 wherein said returning--

Column 11, line 49; delete "20. The method of claim 18 wherein the cooling sys-" and substitute --21. The method of claim 19 wherein the cooling sys- --

Column 12, line 3; delete "21." and substitute --22.--

Column 12, line 13; delete "22. The method of claim 21 including the step of" and substitute --23. The method of claim 22 including the step of--

Column 12, line 16; delete "23. The method of claim 21 including controllably" and substitute --24. The method of claim 22 including controllably--

Column 12, line 20; delete "24. The method of claim 23 including applying a" and substitute --25. The method of claim 24 including applying a--

UNITED STATES PATENT AND TRADEMARK OFFICE

CERTIFICATE OF CORRECTION

PATENT NO. : 5,021,152

DATED : June 4, 1991

INVENTOR(S) : Mark S. Filowitz, Marcel Vataru, James L. Baylor, Rainer H. Labus and Laszlo G. Lugosi It is certified that error appears in the above-identified patent and that said Letters Patent is hereby corrected as shown below:

Column 12, line 24; delete "25." and substitute --26.--

Column 12, line 27; delete "26. The method of claim 21 wherein said returning" and substitute --27. The method of claim 22 wherein said returning--

Column 12, line 30; delete "27. The method of claim 26 wherein the cooling sys-" and substitute --28. The method of claim 27 wherein the cooling sys- --

Column 12, line 36; delete "28. The method of claim 21 wherein said returning" and substitute --29. The method of claim 22 wherein said returning--

Column 12, line 39; delete "29." and substitute --30.--

Signed and Sealed this

Sixteenth Day of March, 1993

*Attest:*

STEPHEN G. KUNIN

*Attesting Officer*

*Acting Commissioner of Patents and Trademarks*